US006113330A

United States Patent [19]

Rupflin

[11] Patent Number: 6,113,330

[45] **Date of Patent: *Sep. 5, 2000**

[54] SCREW CONNECTION ESPECIALLY FOR A HEALD SHAFT CONNECTING ROD IN A LOOM

[75] Inventor: Fritz Rupflin, Lindau, Germany

[73] Assignee: Lindauer Dornier Gesellschaft mbH, Lindau, Germany

[ * ] Notice: Under 35 U.S.C. 154(b), the term of this patent shall be extended for 589 days.

[21] Appl. No.: 08/832,654

[22] Filed: Apr. 4, 1997

Related U.S. Application Data

[63] Continuation-in-part of application No. 08/504,905, Jul. 20, 1995, abandoned.

[30] Foreign Application Priority Data

Jul. 30, 1994 [DE] Germany ..... 44 27 127

[51] Int. Cl.[7] ..... F16B 21/00

[52] U.S. Cl. ..... 411/339; 411/176; 411/180

[58] Field of Search ..... 411/339, 108, 411/116, 143, 166, 168, 172, 174–176, 179, 180, 184, 185, 188, 399, 411

[56] References Cited

U.S. PATENT DOCUMENTS

| | | | |
|---|---|---|---|
| 176,701 | 4/1876 | Spencer . | |
| 375,350 | 12/1887 | Glover | 411/166 |
| 452,640 | 5/1891 | Gerry | 411/399 |
| 722,061 | 3/1903 | Waldo, Jr. . | |
| 1,330,673 | 2/1920 | Anderson . | |
| 2,056,688 | 10/1936 | Peterka | 411/399 |
| 2,096,335 | 10/1937 | Nicholas . | |
| 3,041,912 | 7/1962 | Kreider et al. . | |
| 3,204,284 | 9/1965 | Merriman . | |
| 3,459,447 | 8/1969 | Hurd et al. . | |
| 3,694,013 | 9/1972 | Heitner . | |
| 4,018,257 | 4/1977 | Jack | 151/41.72 |
| 4,097,168 | 6/1978 | Pagel | 411/176 |
| 4,557,650 | 12/1985 | Molina | 411/108 |
| 4,732,518 | 3/1988 | Toosky | 411/108 |
| 4,761,860 | 8/1988 | Krauss . | |
| 4,770,584 | 9/1988 | Vinciguerra . | |
| 4,924,533 | 5/1990 | Stairs | 411/399 |
| 4,966,512 | 10/1990 | Takaku | 411/176 |
| 5,004,361 | 4/1991 | Winnie . | |
| 5,244,326 | 9/1993 | Henriksen . | |
| 5,439,336 | 8/1995 | Muller | 411/179 |
| 5,445,483 | 8/1995 | Fultz | 411/179 |
| 5,454,676 | 10/1995 | Conte . | |
| 5,564,873 | 10/1996 | Ladoucceur | 411/180 |

FOREIGN PATENT DOCUMENTS

| | | |
|---|---|---|
| 0241968 | 10/1987 | European Pat. Off. . |
| 0598165 | 5/1994 | European Pat. Off. . |
| 1492368 | 8/1967 | France . |
| 2114585 | 6/1972 | France . |
| 2466542 | 4/1981 | France . |
| 2621362 | 4/1989 | France . |

*Primary Examiner*—B. Dayoan
*Assistant Examiner*—Gary Estremsky
*Attorney, Agent, or Firm*—W. F. Fasse; W. G. Fasse

[57] ABSTRACT

A screw connection especially for heald shaft rods in a loom, includes a countersunk flathead female threaded nut and a countersunk flathead male threaded screw that engages the nut. To secure the nut against rotation when it is inserted into a stamped conical recess, an outer circumferential cylindrical section of the nut is provided with serrations that engage the edge of the stamped conical recess with a location-fit or press-fit, or friction-fit, whereby the screw can be conveniently connected to the nut, for example for clamping a roller bearing ring between two fork ends of a heald shaft connecting rod. The serrations on the outer surface of the female threaded nut have a first transition area (T1) that forms a lead-in first ramp (R1) for guiding the nut into a countersunk recess. The serrations also have a second transition area (T2) that leads onto a second ramp (R2) formed by a conical surface (3') of the female threaded nut for centering the nut in the conical recess and for maintaining the nut centered even if the screw is loosened.

6 Claims, 2 Drawing Sheets

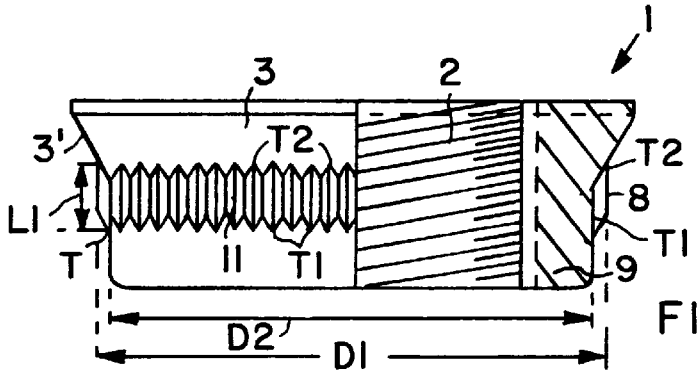
FIG.1
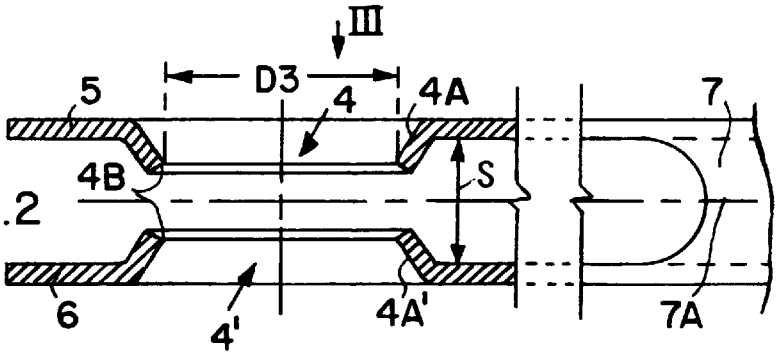
FIG.2
FIG.3
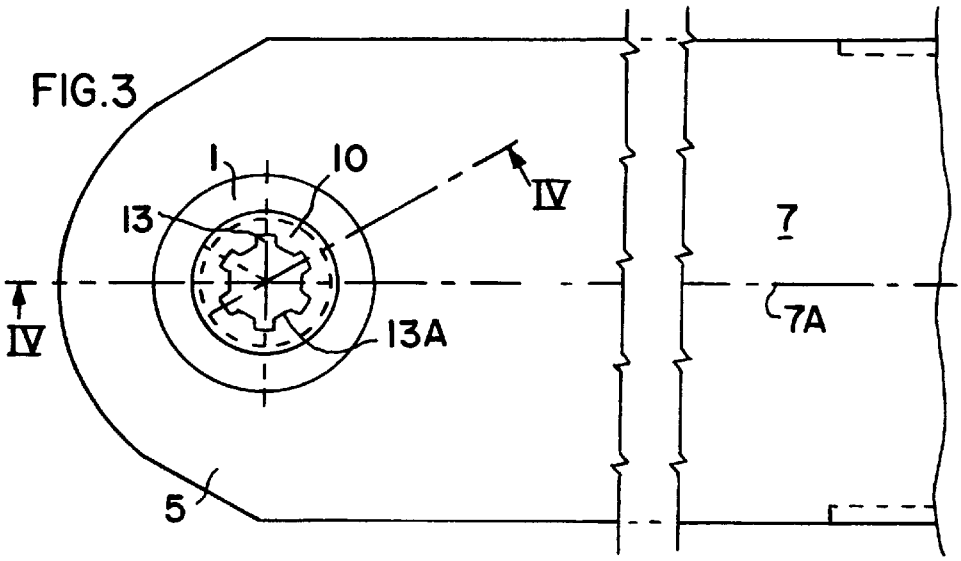
FIG.4
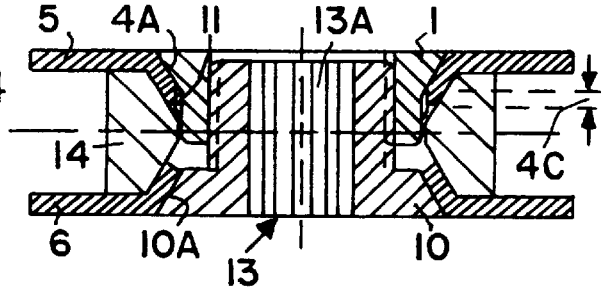

SCREW CONNECTION ESPECIALLY FOR A HEALD SHAFT CONNECTING ROD IN A LOOM

CROSS-REFERENCE TO RELATED APPLICATION

The present application is a Continuation-In-Part application of our commonly assigned application U.S. Ser. No.: 08/504,905, filed on: Jul. 20, 1995 now abandoned.

FIELD OF THE INVENTION

The invention relates to a screw connection especially adapted for connecting a bearing to a heald shaft connecting rod in a loom. Such connections are also suitable for the articulated connections in drive rods and pull rods. The connection includes a nut and a bolt each having a head with a flat surface on one side and a conical surface opposite the flat surface.

BACKGROUND INFORMATION

Known heald shaft rods in looms have a connection end formed into a fork with two fork legs. Each of the two fork legs has an open, conical stamped countersunk recess and these recesses are positioned axially opposite each other. An inner ring of a roller bearing is held in place between the fork legs and the two conical stamped recesses. The recesses are intended to center the inner ring of the roller bearing. It is known to clamp the roller bearing inner ring between the forked legs of the heald shaft rod by a countersunk threaded nut and a countersunk screw, whereby the countersunk nut is loosely received in the stamped recess.

When the bolt and nut are to be interconnected in such a conventional screw connection, there is a tendency that one of the connecting members, either the nut or the screw, turn with the turning of the other member of the connection. This turning is a disadvantage because it makes it rather difficult to assemble or disassemble the heald shaft rods or linkage of a loom equipped with such screw connections.

Furthermore, a certain safety must be provided, for example, against an unintended loosening of the screw and nut connection after the connection has been installed. In order to solve the safety problem it is known to employ a high strength adhesive bonding between the female threading of the nut and the male threading of the screw. However, this solution only solves half of the problem because when the screw connection must be disassembled, for example in order to replace the roller bearing or for any other maintenance reason, it is difficult to achieve the separation of the nut from the screw because the adhesive bonding essentially provides a non-releasable connection so that without special tools the connection cannot be released. Such special tools, for example, involve the use of hot air or a gas flame providing a temperature sufficient to soften the adhesive of the bond. It has been found that such application of heat generally destroys the roller bearing and also diminishes the material strength of the heald shaft rods or links at least in the area where they have been heated.

It is known from French Patent Publication 2,621,362 (Corain et al.), published on Apr. 7, 1989 to connect the fork leg with the bearing carrying rod end with a nut having a female threading cooperating with a male threaded screw and a Belleville washer which when tightened provides an axial force component that is intended to prevent the loosening of the connection in operation.

U.S. Pat. No. 5,244,326 (Henriksen), issued on Sep. 14, 1993, describes a nut and bolt connection for containers, portable housing, and the like, wherein the nut or female screw part is provided with external serrations that are biting into the container walls which are to be interconnected when the nut is hammered in the material of the wall. Once the serrations are in place, they are permanently anchored in the wall material and repeated removal and reinsertion are not intended.

OBJECTS OF THE INVENTION

In view of the above it is the aim of the invention to achieve the following objects singly or in combination:

- to provide a screw connection especially suitable for the articulation points in heald shaft connector rods of looms which on the one hand permit a proper connection of the nut and screw with each other at the time of installation without any difficulties and which also permit a repeated release and retightening of the connection when necessary;
- to avoid the use of an adhesive bond in such connections;
- to assure that the strength of the connection between the nut and the stamped recess is stronger than the torque necessary for tightly screwing the screw into the nut to prevent rotation of the nut when the screw is tightened;
- to provide a nut and screw connection which uses a plastic deformation of at least one of the elements that are to be interconnected even though the deformation is achieved with serrations;
- to provide either the nut or the screw with a lead-in and centering feature to assure a proper guide-in and centering between the connecting components and the connected components so that any canting is prevented and a flush seating of the nut and screw in the respective countersunk recess is assured;
- to use the material of the fork legs as a washer that prevents the loosening of the screw connection, but permits the release of the connection with a tool; and
- to accomplish the connection with two elements, a nut and a screw, to thereby avoid an extra washer or other features that add to the weight of the connection.

SUMMARY OF THE INVENTION

The above objects have been achieved according to the invention by a connection in which a countersunk female threaded nut with a nut head has a first cylindrical section having a first outer diameter connected to a conical section of the nut head and a second cylindrical section connected to the first section. The second cylindrical nut section has a second outer diameter smaller than the first outer diameter. The first larger diameter cylindrical section has such a friction enhancing serrated surface construction that a friction-fit or press-fit or location-fit is established between the nut and a conical stamped countersunk recess to thereby secure the nut against rotation relative to the surface of the stamped recess. Preferably, the surface of the first cylindrical section of the nut is provided with serrations that cover two transition areas and have line ridges. The first transition area is formed between the two cylindrical sections to provide a lead-in ramp. The second transition area is formed between the conical nut head section and the first cylindrical section to facilitate the centering of the nut in a countersunk hole or conical recess.

The connection between the conical surface of the countersunk nut and the stamped conical recess forming the countersunk hole is made rigid against relative rotation therebetween by pressing the nut into its position in the recess to establish a friction or press-fit or location-fit. The countersunk flathead screw is screwed into the countersunk flathead nut with a tool that can be inserted into an axial hole, preferably a through-hole, through the screw. Preferably, the hole has a hexagonal cross-section that extends over the entire screw length for the insertion of a hex key. In order to efficiently apply the tightening torque moment, it is advantageous to use instead of the through-hole with a hexagonal cross-section, a fluted through-hole to provide a plurality of grooves alternating with a plurality of tongues or splines into which a respective tool can be inserted. Where the torque to be applied for the tightening is not large, it is possible to provide the screw with just one entraining or engaging element for a tool.

The above mentioned first lead-in ramp in the first transition area between the first and second outer nut diameters guides the nut centrally into the conical recess to avoid any canting of the nut. The second ramp formed by the conical surface of the conical nut head section near the first larger diameter makes sure that the nut remains centered and the friction enhancing surface extends onto the second ramp in the second transition area to lock the nut in place with its flat nut head surface flush with the surface of a respective connecting rod.

BRIEF DESCRIPTION OF THE DRAWINGS

In order that the invention may be clearly understood, it will now be described, by way of example, with reference to the accompanying drawings, wherein:

FIG. 1 shows a nut according to the invention, wherein the right-hand half is shown in section, and the left-hand half is shown in a side view to illustrate the external serrations;

FIG. 2 is a sectional view through the fork ends of a heald shaft connector rod;

FIG. 3 is a side view of a heald shaft connector rod as seen in the direction of the arrow III in FIG. 2, however with a flathead countersunk nut and screw inserted into conical recesses in the fork ends of the heald shaft connecting rod;

FIG. 4 is a sectional view along section line IV—IV in FIG. 3; and

Figure 5:
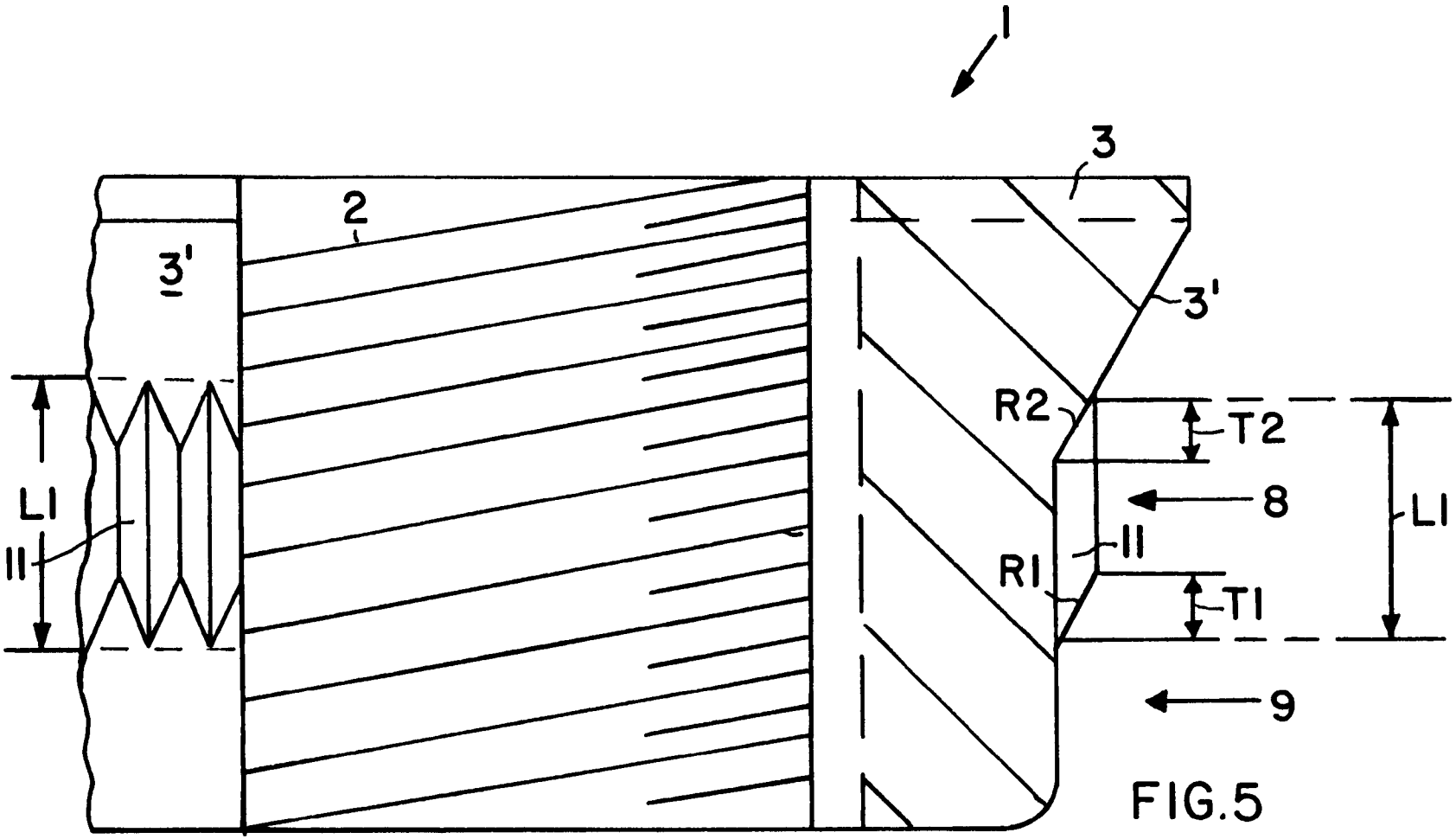
FIG. 5 is an enlarged detail of the right-hand side of the nut according to the invention as shown in FIG. 1 to illustrate the ramps and transition areas of the nut of the present invention.

DETAILED DESCRIPTION OF PREFERRED EXAMPLE EMBODIMENTS AND OF THE BEST MODE OF THE INVENTION

FIG. 1 shows a flathead nut 1 according to the invention having an outer conical surface 3' opposite a flat surface. The nut 1 has a female threading 2 extending along the entire length of a bore through the nut and through a nut head 3 with its outer conical surface 3' that matches a conical wall 4A of a stamped countersunk recess 4 in a fork leg 5 of a heald shaft connecting rod 7 having a further fork leg 6 symmetrical to the fork leg 5 as shown in FIG. 2 relative to a central plane 7A through the connecting rod 7.

According to the invention the conical surface 3' of the head 3 of the nut 1 merges into a first cylindrical section 8 with a first diameter D1 extending axially away from the head 3. A second cylindrical section 9 spaced from the nut head extends axially from the first section 8. The second section 9 has a second diameter D2 smaller than the first diameter D1.

Referring to FIG. 5, a first transition area T1 on the nut 1 connects the first section 8 with the second section 9, whereby a first ramp R1 is formed in the first transition area. A second transition area T2 is formed between the first diameter section 8 and the conical surface 3' of the nut head 3. The conical surface 3' forms a second ramp R2 which is covered at least partly by the second transition area. By making the outer diameter D2 of the section 9 smaller than the outer diameter D1 of the first section 8, the ramp R1 is formed whereby an easy lead-in or guiding of the nut 1 into the recess 4 and into the open bottom of the recess 4 is achieved. As shown in FIGS. 1 and 5, the outer surface of the first larger diameter section 8 is provided with friction enhancing serrations 11 having line ridges along a length L1 which makes the serrations 11 long enough so that the serrations 11 extend along the first cylindrical section 8 and into both transition areas T1 and T2. These serrations have an increasing radial depth in the first transition area T1, a substantially constant depth along a length between the two ramps R1 and R2, and a decreasing depth along the second ramp R2 formed by the conical nut head surface 3', as viewed from bottom to top.

The first ramp R1 assures a proper, centered guide-in of the nut 1 into the countersunk recess 4. The second ramp R2 assures a proper centering of the nut in the recess 4 while the serrations 11 in the second transition area keep the nut centered even if the screw is loosened or removed, whereby the flat nut head surface and the flat screw head surface extend flush with outer surfaces of the two fork legs 5 and 6 that are interconnected when tightening of the male threaded screw engaging the female threaded nut is completed and for keeping the nut centered even if the screw is removed to assure proper reinsertion of the screw into the nut, e.g. when a repair is completed.

Referring to FIG. 2, a hole in the bottom of the conical wall 4A forming the recess 4 has a diameter D3 which is so selected that a location or friction or press-fit is established between the serrations 11 and a deformable edge 4B surrounding the hole in the bottom of the recess 4 when the nut 1 is fully pressed into and centered in the recess 4. The wall 4A surrounding the recess 4 has a cross-section with square corners. Due to the slanting of the wall 4A one of the square corners forms the deformable edge 4B as a line edge which surrounds the hole. This line edge defines the diameter D3. The line ridges of the serrations 11 notch the line edge 4B when the nut 1 is inserted into the recess 4. The line ridges of the serrations 11 deform the single line edge 4B when the nut 1 is fully inserted into the recess 4. Thus, the nut 1 will be held against rotation when a screw 10 is screwed into the nut 1 and the nut will remain centered because the serrations 11 reach onto the ramp R2.

FIG. 3 shows a side view of an end of the heald shaft connecting rod 7 with a nut 1 inserted into the recess 4 in the fork leg 5 and a countersunk flathead screw 10 inserted into the recess 4' in the fork leg 6 of the rod 7. FIG. 3 shows only the screw-in end of the screw 10 and the tool insertion multi-spline bore 13 which passes axially preferably entirely through the screw 10. A plurality of splines 13A and respective grooves form the cross-sectional configuration of the bore 13 for cooperation with a respective tool not shown.

FIG. 4 shows the clamping of an inner ring 14 of a roller bearing in a spacing S between the fork legs 5 and 6 by the full engagement or the nut 1 with the screw 10. In this full engagement state the notches formed in the edge 4B around the bottom hole in the wall 4A by the serrations 11 in the nut 1 extend along the serrations 11. The fit is particularly effective in the second transition area T2. Along a length 4C shown in FIG. 4 where a press-fit is formed. This press-fit applied by the serrations 11 holds the nut against rotation so that screwing in a spacing S between the fork legs 5 and 6 by the full engagement of the nut 1 with the screw 10. In this full engagement state the deformation formed in the single line edge 4B around the bottom hole in the wall 4A by the serrations 11 on the nut 1 provides a press-fit between the serrations 11 and the line edge 4B. The press-fit is particularly effective in the second transition area T2 along a length 4C shown in FIG. 4 where the press-fit is formed. This press-fit applied by the serrations 11 holds the nut against rotation so that screwing the screw 10 into the nut 1 by the engagement of the threadings 2 is easy, especially with a tool inserted into the multi-spline bore 13 of the screw 10. The screw 10 has a head with a conical surface 10A that conforms to the conical surface the wall 4A' of the recess 4' in the fork leg 6. Upon completion of the screw connection the ring 14 is firmly seated between the fork legs 5 and 6 and the location or press or friction-fit is retained.

According to the invention the transition area T1 facilitates the initial lead-in of the nut into the countersunk recess of the connecting rod without substantially deforming the single edge 4B initially until the nut has assumed a precisely centered position. This facilitates the assembly because the transition area T1 functions as a ramp which enhances self-centering of the nut in the conical recess. The deformation of the edge 4B only takes place after the ramp R1 has moved past the respective edge 4B whereupon the serration ridges form notches in the edge 4B rather than displacing material of the wall 4A that forms the edge 4B. Furthermore, the upper ramp R2 in the transition area T2 facilitates the final centered position of the nut in the conical recess to make sure that the outer flat surface is flush with the outer surface of the leg 5 of the connecting rod.

Although the invention has been described with reference to specific example embodiments, it will be appreciated that it is intended to cover all modifications and equivalents within the scope of the appended claims.

What is claimed is:

1. A connector rod for a loom, said connector rod comprising a screw connector, said connector rod (7) having forked rod ends (5, 6), and a bearing (14) secured between said forked rod ends (5, 6) by said screw connector, a spacing (S) between said forked rod ends, said bearing (14) having an axial length fitting into said spacing (S), each forked rod end comprising a conical wall (4A, 4A') surrounding a countersunk conical recess (4, 4') thereby forming two conical recesses (4, 4') positioned in axial alignment opposite each other and extending into said spacing (S), said conical wall comprising an open bottom including a deformable single line edge (4B) facing radially inwardly, said screw connector consisting of a female threaded nut (1) with a nut head (3) having a flat outer surface and a conical nut surface (3') opposite said flat outer surface, said conical nut surface (3') being received in one of said conical recesses (4), a torque resistant engagement between said single deformable line edge (4B) of said conical wall (4A) of said one conical recess (4) and said female threaded nut (1), said torque resistant engagement (11) comprising as an integral part of said female threaded nut serrations (11) having a plurality of line ridges that deform said deformable single line edge (4B) for holding said nut (1) against rotation and against unintended axial withdrawal, and a male threaded screw (10) with a screw head (10A) having a conical surface in the other recess (4'), said male threaded screw engaging said female threaded nut.

2. The connector rod of claim 1, wherein said connector rod is a heald shaft connecting rod in a loom.

3. The connector rod of claim 1, wherein said torque resistant engagement between said deformable single line edge (4B) of said conical wall (4A) and said female threaded nut (1) is a releasable friction-fit.

4. The connector rod of claim 1, comprising a press-fit between said plurality of serrations (11) of said female threaded nut and said single line edge (4B) of said conical wall, said press-fit being effective against axial withdrawal of said female threaded nut, and a location-fit between said plurality of serrations and said single line edge (4B), said location-fit being effective against rotation of said female threaded nut in said recess.

5. The combination of claim 1, wherein said screw head has an axial hole (13), for cooperation with a tool.

6. The connector rod of claim 1, wherein said female threaded nut comprises near said conical nut surface (3') a first cylindrical section (8) having a first diameter (D1) and, spaced from said conical nut surface (3'), a second cylindrical section (9) having a second diameter (D2) smaller than said first diameter (D1), said serrations (11) extending along said first cylindrical section (8) for interlocking with said single deformable line edge (4B), said serrations (11) comprising a first transition area (T1) between said first and second cylindrical sections (8, 9), said first transition area (T1) forming a lead-in first ramp (R1) for guiding said female threaded nut into said countersunk conical recess (4, 4') in one of said forked rod ends (5, 6) to be interconnected before any interlocking becomes effective to form said torque resistant engagement, said serrations (11) further comprising a second transition area (T2) between said first cylindrical section (8) and said conical nut surface (3'), said second transition area forming a second ramp (R2) for centering said female threaded nut (1) in said countersunk conical recess (4), said serrations (11) extending along said second ramp (R2) for maintaining a centered, interlocked position of said female threaded nut in said countersunk conical recess (4), whereby said flat nut head surface and said flat screw head surface extend flush with outer surfaces of said forked rod ends (5, 6) when tightening of said male threaded screw and said female threaded nut is completed and said nut and screw are centered in said countersunk conical recesses (4, 4') and the nut remains centered even if the screw is removed.

* * * * *